United States Patent [19]

Tartaglia et al.

[11] Patent Number: 4,723,673

[45] Date of Patent: Feb. 9, 1988

[54] TAMPER RESISTANT CAP WITH INDICATOR

[76] Inventors: Marc S. Tartaglia; Marc S. Tartaglia, Jr.; Peter A. Tartaglia; Michael J. Tartaglia; Daniel J. Tartaglia, all of 51 Petry Dr., East Hanover, N.J. 07936

[21] Appl. No.: 35,100

[22] Filed: Apr. 6, 1987

[51] Int. Cl.[4] ..... B65D 55/02

[52] U.S. Cl. ..... 215/230

[58] Field of Search ..... 215/230; 116/307, 309, 116/305, 299, 294

[56] References Cited

U.S. PATENT DOCUMENTS

| | | | |
|---|---|---|---|
| 2,939,597 | 6/1960 | Greene | 215/230 |
| 4,440,306 | 4/1984 | Van Buskirk et al. | 215/230 |
| 4,444,328 | 4/1984 | Glass | 215/230 |
| 4,456,139 | 6/1984 | Glass | 215/230 X |

*Primary Examiner*—Donald F. Norton
*Attorney, Agent, or Firm*—Edward R. Weingram

[57] ABSTRACT

A cap assembly for a threaded neck of a container includes an inner threaded cap which fits closely within an outer cap that is rotatable about the inner cap within defined limits. The outer cap includes a transparent window through which means are displayed to provide a positive indication of a prior usage or tampering. In one embodiment, a drive bar and a series of breakable fins on the outer cap seen through the window are moved into contact with a break and open bar on the inner cap. After the fins are broken, the drive bar engages the break and open bar to permit rotation of the inner cap with the outer cap and removal of the assembly to open the container. Replacement in the opposite direction causes the drive bar to engage a close bar on the inner cap to reseal the container while the broken fins remain visible. A second embodiment has an indicator sleeve instead of fins with a second drive bar to move a SAFE indicia in view of the window during the opening rotation. When the cap is replaced and tightened, a warning symbol moves into view to indicate the prior opening. The original safe position cannot be restored without damaging the cap.

10 Claims, 14 Drawing Figures

TAMPER RESISTANT CAP WITH INDICATOR

BACKGROUND OF THE INVENTION

1. Field of the Invention

The present invention relates to tamper resistant caps for containers and particularly to a cap for a threaded container which provides a positive indicator device to clearly show that the container has been opened previously or that the cap has been tampered with.

2. Description of the Prior Art

Various packaging devices have included means to ensure that the contents are sealed against contamination. These include simple adhesive seals over the container opening under the cap, breakable sections which remain on the neck when the cap is twisted off and plastic enclosures which must be removed for access to the cap. In many cases, the caps can be replaced and there is no indication that the container was previously opened or tampered with. In view of recent incidents involving poisoning of medications and foods, it has become more urgent to find improved cap sealing and indicator devices. Examples of such known prior art devices are found in U.S. Pat. No. 4,572,389 wherein an external satellite band is secured to a cap by a flange or struts which are broken when the cap is twisted off. Removal of the band reveals the fractured portions and indicates a previous opening. U.S. Pat. No. 4,570,810 shows another band secured between a bottle neck and a cap which reguires breaking and removal of the inner member to display signs of tampering. In U.S. Pat. No. 4,456,139, a transparent wall portion of a cap permits visual observation of a broken seal. A further variation appears in U.S. Pat. No. 4,444,328 wherein a container and closure have openings which are out of alignment in a closed position and moved into alignment in an open position. Visual indicia provide indication of a safe unopened position. An arrangement of cams and stops prevent return of the closure into the first position. These various devices however do not provide sufficiently clear and direct evidence of prior use or tampering, are relatively inefficient and complex, and often require parts that can only be used with special enclosures rather than screw type caps that engage threaded necks of standard containers.

SUMMARY OF THE INVENTION

It is therefore the primary object of the present invention to provide a tamper resistant cap for a container which provides a clearly observable indication of prior use or tampering.

It is a further object of the invention to provide a screw-on type cap which can be twisted off and replaced in a normal manner after indicating the first usage but cannot reverse that indication.

Another object of the invention is to provide a cap arrangement for a standard threaded neck container including a mechanism which visibly indicates the first rotation or removal of the cap.

It is also an object of the invention to provide a cap having a transparent window which enables direct observation of the mechanism for indicating usage.

An additional object of the invention in one embodiment is to provide a visible fracturing of a series of elements to indicate a first use.

It is an object of a second embodiment to provide visible indicia as a display of the first use.

A still further object is to provide a relatively simple and more effective tamper resistant cap and mechanism for warning the user of a prior opening of the cap.

These objects are achieved with a dual cap structure including a first inner cap which is threaded to fit securely onto a standard threaded neck container and a second outer cap which fits over and closely engages the inner cap and is rotatable with respect to the inner cap within defined limits The outer cap includes a transparent window and in one embodiment has a series of internal breakable fins or pins arranged around a circumferential path within the sector of rotation of the cap and visible through the transparent window. The outer cap also includes an inner drive bar at one side of the fins while the inner cap includes a sharp edged breaker bar at the other side of the fins. As the outer cap is twisted in the opening counterclockwise direction with the inner cap remaining secured in position on the neck of the container, the fins are advanced into engagement with the breaker bar which breaks the fins successively as the outer cap is continuously rotated. This occurs in full view through the transparent window of the outer cap, so that the broken fins provide a clear definite indication of the opening rotation of the outer cap. As the drive bar engages the breaker bar, the inner cap then is also moved counterclockwise with the continued rotation of the outer cap until both caps can be twisted off together and removed from the threaded neck of the container. When the dual cap is replaced and screwed back on in a clockwise direction, the drive bar engages a close bar on the inner cap which is rotated until threaded tightly onto the container neck in the original position. The broken fins however remain visible through the window to clearly indicate the prior opening.

A second embodiment includes an added indicator sleeve in place of the breakable fins. An additional drive bar moves a SAFE indicia in view of the window as the cap is opened, but when the cap is replaced and tightened, a warning symbol moves into view. The indicator sleeve cannot be moved back to the original safe position so that the warning sign remains in view to indicate the previous opening.

Other objects and advantages will become apparent from the following description in conjunction with the accompanying drawings.

Figure 8:
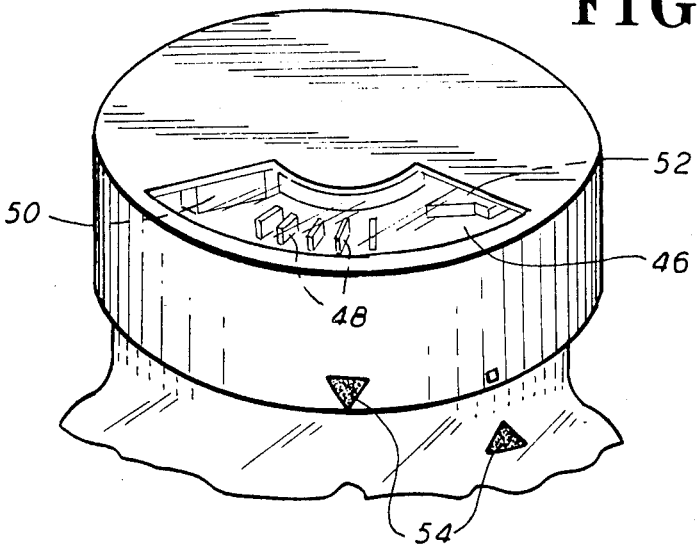
Figure 9:
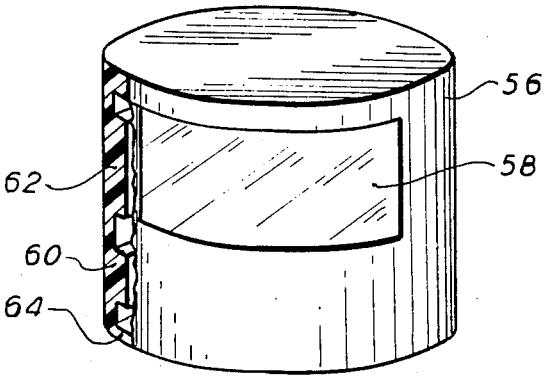
Figure 11:
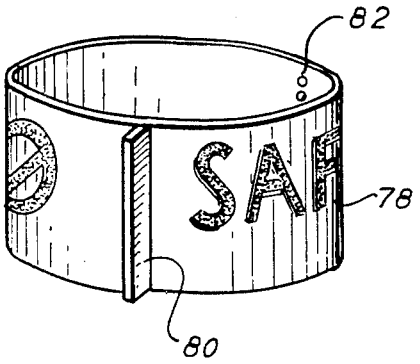
Figure 10:
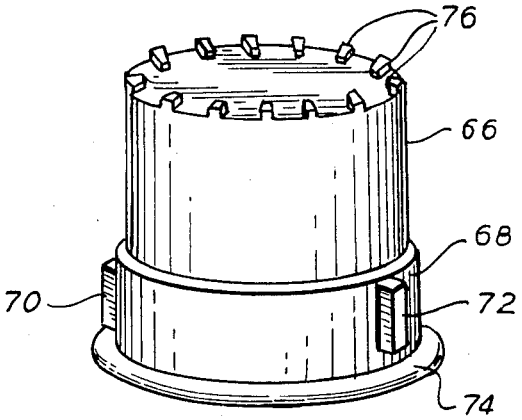
Figure 12:
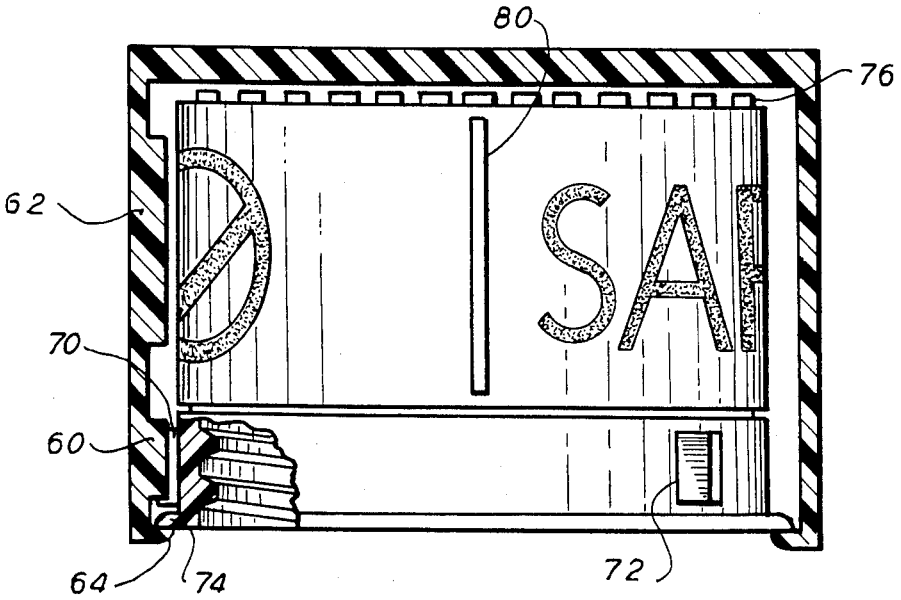

FIGS. *7a, 7b* and *7c* are further top views of the cap assembly in cross-section with the upper portion of the inner and outer caps removed to show the operation of the various elements in different positions during counterclockwise rotation as the cap is twisted to open the container;

FIG. 8 is a perspective view of another outer cap arrangement having a window on the upper surface;

FIG. 9 is a perspective view in partial cross-section of a third outer cap incorporating features of a further embodiment of the invention;

FIG. 10 is a perspective view of an inner cap having features cooperating with the outer cap of FIG. 9;

FIG. 11 is a perspective view of an indicator sleeve used in conjunction with the outer and inner caps of FIGS. 9 and 10; and FIG. 12 is a side view in partial cross-section of an assembly of the outer and inner caps and indicator sleeve of FIGS. 9, 10 and 11.

DESCRIPTION OF THE PREFERRED EMBODIMENTS

Figure 1:
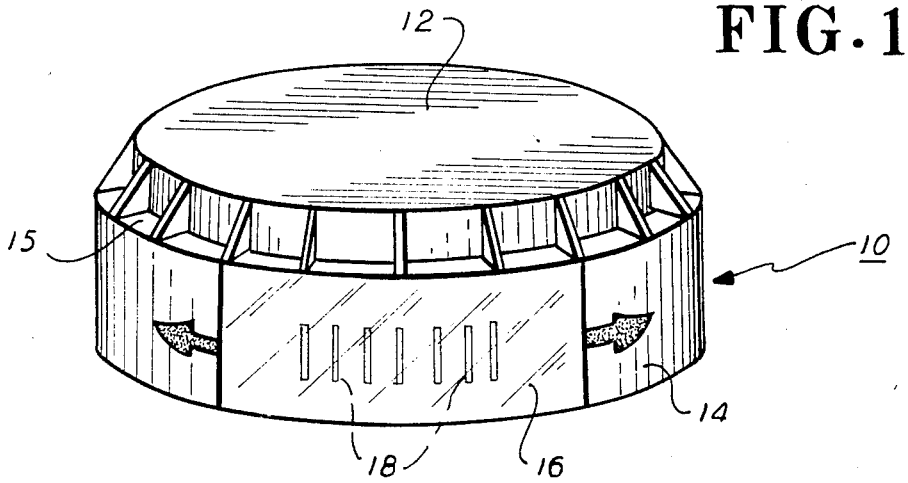
FIG. 1 is a perspective view of an outer cap incorporating features of a first embodiment of the invention including a side window.
Figure 2:
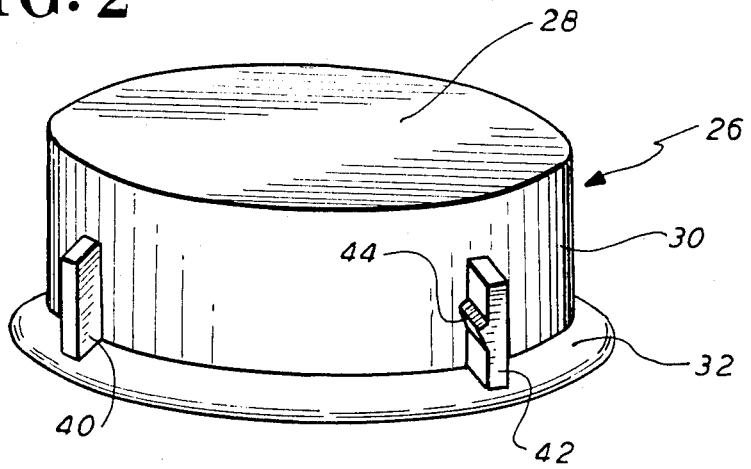
FIG. 2 is a perspective view of an inner cap having features cooperating with the outer cap of FIG. 1.
Figure 6:
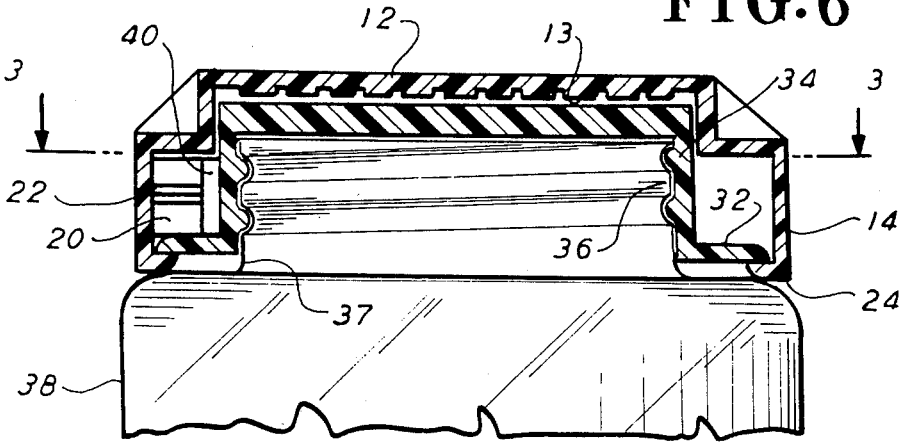
FIG. 6 is a side view in partial cross-section of an assembly of the outer and inner caps of FIGS. 4 and 5 taken along line 4—4 of FIG. 3 in engagement with the threaded neck of a container.
Figure 3:
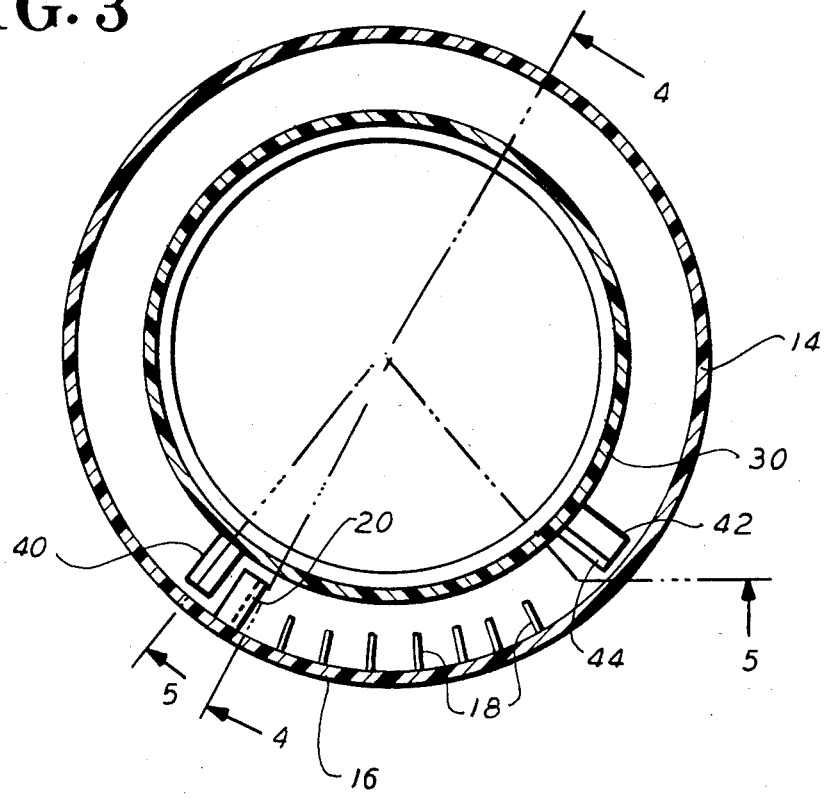
FIG. 3 is a top cross-sectional view of the assembled outer and inner caps with the upper portion of the inner and outer caps removed.
Figure 4:
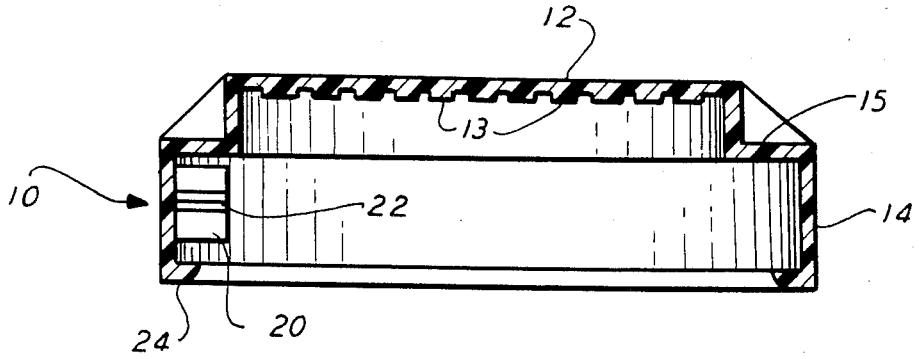
FIG. 4 is a side view in cross-section of the outer cap of FIG. 1 taken along line 4—4 of FIG. 3.
Figure 5:
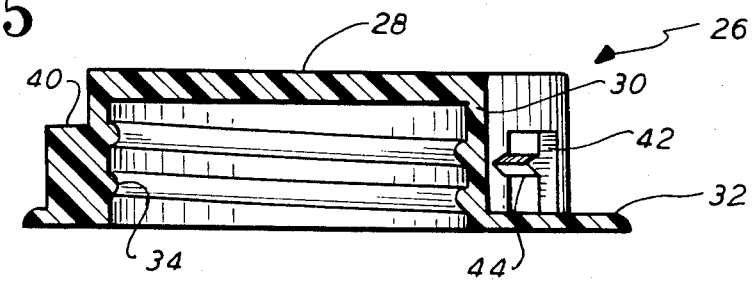
FIG. 5 is a side view in partial cross-section of the inner cap of FIG. 2 taken along line 5—5 of FIG. 3.
Figure 7A:
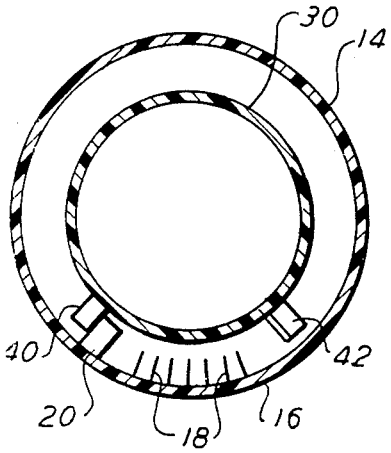
Figure 7B:
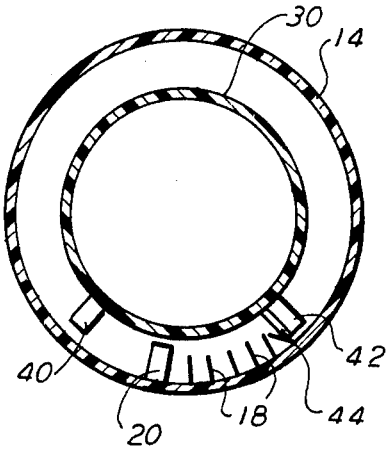
Figure 7C:
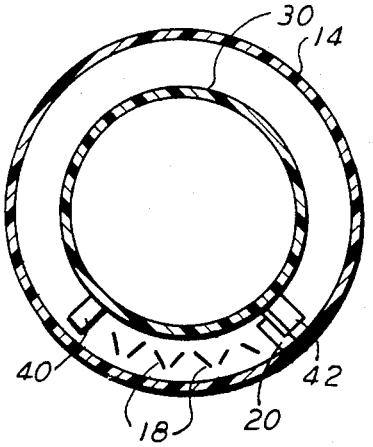

As shown in FIGS. 1–6, an outer cap 10 of a suitable rigid plastic material includes a flat circular top portion 12 with operating instructions embossed on the outer surface, and a plurality of ridges or spacers 13 extending from the inner surface. An annular side wall 14 extending from a shoulder 15 includes a transparent arcuate window section 16. Extending internally from the window 16 are a plurality of thin vertical breakable fins 18, also shown in a top view in FIGS. 3 and *7a–c*. A drive bar 20 is formed on the inside wall of the outer cap adjacent the left side of the fins 18. The drive bar includes a wedge-shaped lateral groove 22, shown in FIG. 4. The side wall also includes an inwardly extending lower lip 24. As shown in FIG. 2, an inner cap 26 has a circular top portion 28, an annular side wall 30 and an outwardly extending flange 32. As shown in FIGS. 5 and 6, the inside of side wall 30 includes threads 34 which are adapted to engage corresponding threads 36 on a neck 37 of a container 38. A close bar 40 is formed on the outer side wall and is positioned to the left of the drive har 20 of the outer cap, as shown in the top view of the assembly of FIG. 3. An open and break bar 42 is also formed on the outside wall adjacent the other side of the fins and includes a wedge-shaped protrusion 44 extending laterally across the face of the bar.

As shown in FIG. 6, the inner and outer caps are assembled by pressing the inner cap 26 into the outer cap 10 until the tip of flange 32 is snapped into engagement with lip 24. The upper edge of flange 32 and the lower edge of lip 24 are rounded to facilitate the insertion of the flange while the opposite edges are rectangular to make disengagement difficult. The preferred plastic materials are also relatively rigid so that when the inner cap is threaded tightly onto the neck 37 of container 38, the outer cap cannot be pried off at the edges without causing damage that would indicate tampering.

In order to twist the assembled cap enclosure off the container neck in the usual counterclockwise rotation, the outer cap is free to rotate within limits around the tightly secured inner cap. As shown in FIGS. *7a–7c*, as the annular side wall 14 of the outer cap is moved counterclockwise, the drive bar 20 and fins 18 move toward break bar 42 on the stationary inner cap. As the thin breakable fins come into contact with the sharp edge of protrusion 44, the individual fins break and fall into the space between outer wall 14 and inner wall 30. The breaking of the fins which can be seen through transparent window 16 is thus a permanent visible indication of a previous opening of the cap and container. When all the fins are broken, drive bar 20 with the lateral groove 22 engages break bar 42 and protrusion 44 to drive the inner cap in the counterclockwise direction to permit the entire assembly of the inner and outer cap to be twisted off and removed from the neck of the container and provide access to the contents. When the cap assembly is replaced and twisted back onto the container in a clockwise rotation, drive bar 20 on the outer cap moves freely away from break bar 42 and then engages close bar 40 on the inner cap. Continued clockwise rotation causes the inner cap to be again tightened on the threaded neck of the container and bar 40 prevents further movement of the outer cap. The caps are then in the original position for reuse but the missing and broken fins remain as a visible indication through window 16 of a warning that the container was previously opened or tampered with.

A variation of this cap assembly is shown in FIG. 8, wherein the arcuate window 46 is on the upper surface of the outer cap, the fins 48 and drive bar 50 extend downwardly from the window and cap and the break bar 52 extends from an opposing area of the inner cap to the right of the window. The opening movement, breaking of fins on the window and closing operations are the same as previously. An arrow and key arrangement 54 which reguire alignment in order to permit opening of the cap may be used as a safety measure to prevent undesired opening by young children. In addition, to provide initial resistance when opening the cap, the male thread on the inner cap may include a vertical notch and the female thread on the container neck may include a mating ridge located close to the end of the top thread. Sufficient twisting force causes disengagement of the notch and ridge to permit opening of the cap. A breakable stop may also be added on the inner cap adjacent the drive bar on the outer cap to hold the drive bar in place before initial opening movement. A plurality of breakable vertical pins may be employed in place of the fins. In that case, a wedge-shaped ridge may be disposed on the drive bar and a wedge-shaped groove may be disposed on the break bar.

A further embodiment of the invention is shown in FIGS. 9–12, wherein a cylindrical outer cap 56 includes a side window 58, an open and close drive bar 60 near the lower end and an indicator sleeve drive bar 62 near the upper end. The lower edge includes a lip 64 to hold the assembly together. The inner cylindrical cap 66 includes a lower circumferential ring 68 having a close bar 70 at one side and an open bar 72 at the other side. A lower edge 74 is engageable with the lip 64 of the outer cap. The inner cylindrical surface of the inner cap is threaded to engage the threaded neck of a container. The upper edge may include ridges 76 to facilitate movement of the outer cap on the inner cap. The ridges may also be disposed on the inside surface of the top of the outer cap instead.

An indicator sleeve 78 having an open bar 80 is adapted to slide over the upper cylindrical area of the inner cap and rest on the shoulder of ring 68. Pimples 82 on the inner surface of the sleeve cause the sleeve to be held in position after being rotated in a counterclockwise opening movement of the cap so that it cannot be returned to the original unopened position. Embossed on different areas of the indicator sleeve separated by the open bar 80 are the words SAFE, visible through the window 58 in the original position, and the symbol ⊘ indicating unsafe. The latter does not appear until the cap has been closed after an initial opening.

In the assembled cap, as shown in FIG. 12, the indicator sleeve, shown in an intermediate position for illustrative purposes, is placed over the upper portion of the inner cap with the sleeve open bar 80 against the sleeve drive bar 62 on the inside of the outer cap. The pimples on the sleeve also hold the sleeve in this position until force is applied to open the cap. The inner cap and sleeve are inserted into the outer cap and snapped into position through lip 64 which then engages edge 74 to prevent removal of the outer cap without a visible indication of damage. The inner cap is tightened onto the container neck so that it resists movement during the initial twisting of the outer cap during opening.

The movement of the caps during opening and closing operations is similar to that of the caps described above, except for the indicator sleeve which is used in place of the breakable fins. In this case the rotation of the outer cap in the opening counterclockwise direction causes the lower drive bar 60 to move toward the open bar 72 on the tightened inner cap while sleeve drive bar 62 moves sleeve open bar 80 with the word SAFE displayed in the window area 58. Continued opening movement brings the lower drive bar 60 into contact with the open bar 72 while the word SAFE remains in view through the window which is rotating with the outer cap. Thereafter the drive bar 60 causes the open bar 72 and the inner cap to move counterclockwise until the entire assembly can be twisted off the threaded neck of the container to permit access to the contents.

When the cap assembly is placed back on the container neck and twisted clockwise to again tighten the inner cap, the window on the outer cap moves beyond the stationary SAFE indication to the area of the ⊘ symbol which is then displayed through the window. This position then is an indication of the unsafe condition and that the container has been previously opened. The unsafe symbol would also be displayed whenever the cap is moved clockwise in a closing rotation after an initial opening rotation without the cap being completely removed from the container. The tightening action is then completed when the drive bar 60 contacts the close bar 70 to move the inner cap as far as possible into engagement with the threaded neck while also limiting further movement of the outer cap. The display of the unsafe symbol ⊘ thus continues to be visible through the window when the cap is tightened into its original position and the SAFE indicator is held in place and cannot be moved back without breaking or mishandling the cap which would further indicate that it had been tampered with. Again, a similar configuration can be used with a window in the top of the cap rather than the side and a key and opening arrangement can be used to prevent young children from inadvertently opening the container.

While only a limited number of embodiments of the invention have been illustrated and described, it is apparent that many variations may be made in the particular design and configuration without departing from the scope of the invention as set forth in the appended claims.

What is claimed is:

1. A cap assembly for a container neck providing means for indicating a prior usage comprising:

an inner cap including an annular side wall having internal threads for engaging corresponding threads on the neck of a container and an annular flange extending outwardly from the lower end of said side wall, a top wall, a close bar extending outwardly along a section of one of said walls, an open bar extending outwardly along another section of said one wall spaced angularly from said close bar;

an outer cap adapted to receive said inner cap therein and being rotatable with respect to said inner cap and having an annular side wall spaced from said inner cap side wall, an annular flange extending inwardly from the lower end of said outer cap side wall and adapted to fit over and closely engage said inner cap annular flange, a top wall spaced from said inner cap top wall, a drive bar extending inwardly along a section of one of said outer cap walls, said drive bar being adapted to be moved into engagement with said open bar of said inner cap during an opening rotational movement of said outer cap on said inner cap and upon engagement move said inner cap with said outer cap to permit removal of said cap assembly from the threaded neck of the container, said drive bar being adapted to engage said close bar of said inner cap during a reverse closing rotational movement of said outer cap to permit tightening of said inner cap on the threaded neck of the container, one of said outer cap walls having a transparent window in at least an arcuate section thereof; and means for visually indicating through said transparent window that said outer cap has been moved in a rotational direction to open the container, said indicating means having an initial condition when the cap assembly is in a closed position which after movement into an opening position cannot be restored by return to a closed position.

2. The cap assembly of claim 1 wherein said indicating means are a plurality of breakable fins extending vertically and spaced along a wall of said outer cap in the area of said window, said inner cap open bar having a wedged extension for successively breaking said fins in view of said window as said outer cap is moved to open the container, said drive bar engaging said open bar after said fins are broken to move said inner cap in the opening direction.

3. The cap assembly of claim 2 wherein said inner cap close and open bars extend vertically along said side wall, said outer cap drive bar extends vertically along said spaced side wall and said transparent window is in said outer cap side wall.

4. The cap assembly of claim 2 wherein said inner cap close and open bars and outer cap drive bar extend from respective top walls and said transparent window is in said outer cap top wall.

5. The cap assembly of claim 2 wherein said drive bar includes a wedge shaped groove engageable with said wedged extension of said open bar.

6. The cap assembly of claim 1 wherein said inner cap close and open bars extend vertically along said side wall, said outer cap drive bar extends vertically along said spaced side wall, and said transparent window is in said outer cap side wall.

7. The cap assembly of claim 6 wherein said indicating means is an intermediate sleeve disposed over an upper smaller diameter portion of said inner cap in the space between said inner and outer caps, said sleeve having an open bar extending vertically along an outer wall section, said outer cap having an upper drive bar extending inwardly along said spaced side wall for engaging said sleeve open bar and having a lower drive bar for engaging said inner cap open bar, said sleeve having indicia on a first outer wall section indicating a safe position and a second outer wall section indicating an unsafe position, said sleeve open bar separating said first and second outer wall sections, said indicia on said sleeve being visible through said outer cap window during respective opening and closing movements of said cap assembly, said outer cap and upper drive bar moving said sleeve open bar to display said safe indicia during an initial opening rotation and said outer cap and lower drive bar moving around said inner cap to engage said inner cap open bar to permit removal of said cap assembly from the container neck, said lower drive bar moving into engagement with said inner cap close bar during a reverse closing rotational movement with said outer cap and transparent window moving with respect to said sleeve to display said second sleeve section indicating said unsafe position when said cap assembly is again tightened into a closed position.

8. The cap assemhly of claim 7 including a plurality of raised pimples on the inner surface of said sleeve to hold said sleeve in position on said inner cap when said outer cap upper drive bar is not in engagement with said sleeve open bar in an opening movement.

9. The cap assembly of claim 1 including a plurality of ridges on the inner surface of said outer cap top wall to facilitate movement of said outer cap on said inner cap.

10. The cap assembly of claim 1 wherein the upper inner edges of said inner cap annular flange and lower outer edges of said outer cap annular flange are rounded to facilitate insertion of said inner cap into said outer cap and the opposite edges are rectangular to prevent removal therefrom.

* * * * *